US010870188B2

(12) United States Patent
Sanford et al.

(10) Patent No.: US 10,870,188 B2
(45) Date of Patent: Dec. 22, 2020

(54) SCREWDRIVER WITH FORCE APPLYING MEMBER

(71) Applicant: IDEAL Industries, Inc., Sycamore, IL (US)

(72) Inventors: Douglas A. Sanford, Naperville, IL (US); Michael Richard Weiby, Bartlett, IL (US); Carl C. Aldag, Palatine, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 294 days.

(21) Appl. No.: 16/050,046

(22) Filed: Jul. 31, 2018

(65) Prior Publication Data

US 2019/0134794 A1 May 9, 2019

Related U.S. Application Data

(60) Provisional application No. 62/545,063, filed on Aug. 14, 2017.

(51) Int. Cl.
*B25B 23/10* (2006.01)
*B25B 15/00* (2006.01)
*B25B 23/02* (2006.01)

(52) U.S. Cl.
CPC ..... *B25B 23/101* (2013.01); *B25B 15/007* (2013.01); *B25B 23/02* (2013.01)

(58) Field of Classification Search
CPC ... B25B 23/101; B25B 23/105; B25B 23/106; B25B 23/108
See application file for complete search history.

(56) References Cited

U.S. PATENT DOCUMENTS

| | | | | |
|---|---|---|---|---|
| 2,404,427 | A * | 7/1946 | Bloomfield | B25B 23/106 81/443 |
| 3,245,446 | A * | 4/1966 | Morifuji | B25B 23/101 81/452 |
| 3,286,749 | A | 11/1966 | Learned | |
| 3,517,714 | A | 6/1970 | Desbarats | |
| 4,105,056 | A * | 8/1978 | Arnn | B25B 15/007 81/436 |
| 4,221,249 | A | 9/1980 | Mazzeo et al. | |
| 4,457,654 | A * | 7/1984 | Sygnator | F16B 37/14 411/375 |

(Continued)

FOREIGN PATENT DOCUMENTS

| | | |
|---|---|---|
| CN | 201565884 | 9/2010 |
| GB | 846337 | 8/1960 |

OTHER PUBLICATIONS

ISA/U.S. International Search Report and Written Opinion issued on PCT application No. US18/44734, dated Oct. 23, 2018, 8 pages.

*Primary Examiner* — David B. Thomas
(74) *Attorney, Agent, or Firm* — Greenberg Traurig, LLP

(57) ABSTRACT

A device for driving a fastener has a shaft and a driving portion formed on an end of the shaft. The driving portion is provided with one of a slot and a channel for securely holding a force applying member formed from a resilient material. When a tip of the driving member is positioned within a tip receiving portion tip portion of the fastener, a surface of the force applying member which faces towards the head of the fastener will frictionally engage with the head portion of the fastener to prevent the driving portion from slipping from the fastener.

17 Claims, 6 Drawing Sheets

(56) References Cited

U.S. PATENT DOCUMENTS

| | | | | |
|---|---|---|---|---|
| 5,237,893 | A * | 8/1993 | Ryder | B25B 23/108 81/436 |
| 6,138,538 | A | 10/2000 | Neijndorff | |
| 6,302,001 | B1 * | 10/2001 | Karle | B25B 23/108 81/436 |
| 6,684,741 | B2 * | 2/2004 | Blackston | B25B 23/105 81/436 |
| 6,971,293 | B2 * | 12/2005 | Appenzeller | B25B 23/108 81/125 |
| 7,017,457 | B2 * | 3/2006 | Nessbaum | A61B 17/8875 81/177.85 |
| 7,137,322 | B2 * | 11/2006 | Mark | A61B 17/888 81/452 |
| 7,140,281 | B1 * | 11/2006 | Ruff | B25B 15/008 81/452 |
| 7,249,544 | B2 * | 7/2007 | Totsu | B25B 15/005 81/448 |
| 8,726,769 | B1 | 5/2014 | Jacker | |
| 9,314,907 | B2 * | 4/2016 | Wang | B25B 15/008 |
| 9,375,830 | B2 * | 6/2016 | Kana | B25B 23/105 |
| 10,005,174 | B2 * | 6/2018 | Wang | B25B 15/008 |
| 10,646,981 | B2 * | 5/2020 | Kennedy | B25B 23/106 |
| 2005/0115370 | A1 | 6/2005 | Totsu | |
| 2014/0305267 | A1 | 10/2014 | Baroody | |
| 2015/0089787 | A1 | 4/2015 | Schon et al. | |
| 2018/0043514 | A1 * | 2/2018 | Feng | B25B 21/00 |

* cited by examiner

SCREWDRIVER WITH FORCE APPLYING MEMBER

RELATED APPLICATION INFORMATION

This application claims the benefit of U.S. Provisional Application No. 62/545,063, filed on Aug. 14, 2017, the disclosure of which is incorporated herein by reference in its entirety.

BACKGROUND

Screwdrivers having an associated fastener holding element in the form of an elastomeric, tubular sleeve that is disposed over the shaft of the screwdriver and which is sized and arranged to grip and hold the head of a screw when the screw is engaged with the driving portion of the screwdriver are generally known in the art. Examples of screwdrivers having such fastener holding elements may be seen in U.S. Pat. No. 8,726,769, GB 846,337, and CN 201565884U.

Screwdrivers having an associated protective element in the form of an elastomeric, tubular sleeve that is disposed over the shaft of the screwdriver and which is sized and arranged to prevent marring of finished surfaces as the screwdriver is used to drive a screw into a workpiece are also generally known in the art. Examples of screwdrivers having such protective elements may be seen in U.S. Pat. No. 6,138,538 and US 2006/026166.

Each of these publications is incorporated herein by reference in its entirety.

SUMMARY

Described herein is an improved fastener driving tool wherein the tool is particularly adapted to securely hold a force applying member. In addition, various force applying members for use with the tool are described. In operation, when the tip of the driving portion of the tool is placed into the tip receiving portion provided to fastener, such as the head of a screw, the force applying member will apply a force upon the fastener to thereby inhibit the driving portion of the tool from slipping off of the fastener.

While described in the exemplary context of a screwdriver, those of skill in the art will readily understand how to use the teachings that are provided herein to modify other fastener driving devices to achieve this same goal.

A better understanding of the objects, advantages, features, properties and relationships of the systems described hereinafter will be obtained from the following detailed description and accompanying drawings which set forth illustrative examples and which are indicative of the various ways in which the subject systems may be employed.

BRIEF DESCRIPTION OF THE DRAWINGS

For a better understanding of the screwdriver systems hereinafter described, reference may be had to preferred examples shown in the attached drawings in which.

Figure 1A:
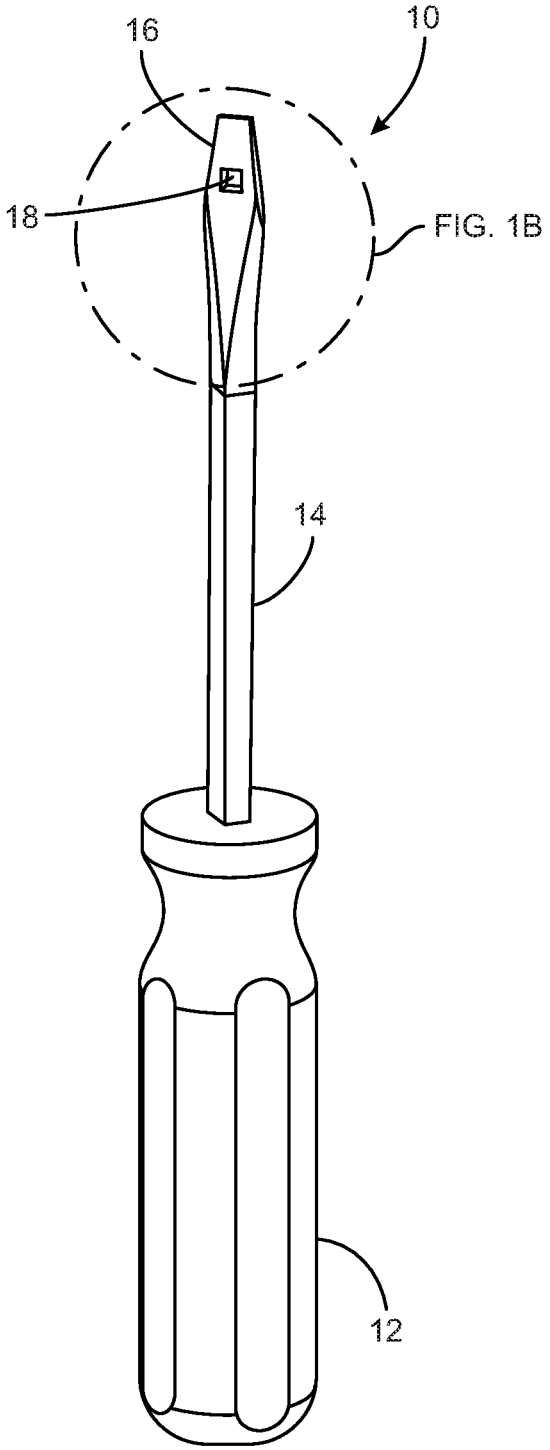
FIG. 1A illustrates an exemplary screwdriver adapted to securely hold a force applying member.

It is to be appreciated that the drawing are presented for illustration purposes only and, as such, are not drawn to scale.

DETAILED DESCRIPTION

The following describes a fastener driving tool having a force applying member for providing, among other things, the tool with an anti-slip feature.

Figure 1B:
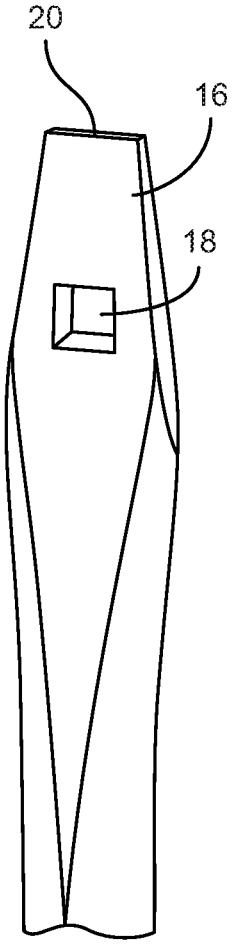
FIG. 1B illustrates a close up view of a driving element of the screwdriver illustrated in FIG. 1A
Figures 2A, 2B:
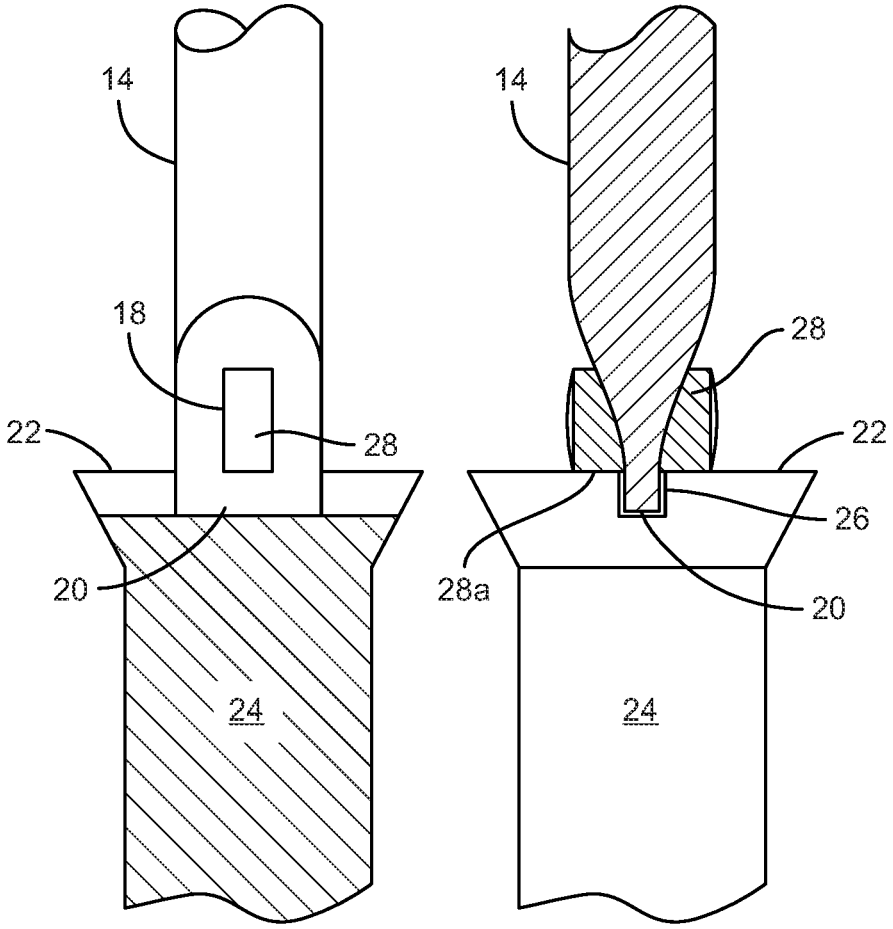
FIG. 2A illustrates a first side view of a first example force applying member for use with the screwdriver illustrated in FIG. 1A.
FIG. 2B illustrates a second side view of the first example force applying member of FIG. 2A.

By way of example, FIGS. 1A and 1B illustrate a fastener driving tool in the exemplary form of a flathead screwdriver 10. As shown, the screwdriver 10 includes a handle 12, a shaft 14 which extends from the handle 12, and a driving portion 16 which is formed at the end of the shaft 14 opposite the handle 12. The driving portion 16 has formed therein a slot 18 for use in securely holding a force applying member. The slot 18 is preferably formed in the driving portion 16 at a location that is spaced from the tip 20 of the driving portion 16 whereby, as described hereinafter and as generally shown in FIGS. 2A and 2B, the force applying member may be secured to the driving portion 16 in a manner that allows an end of the force applying member to frictionally engage with the head 22 of the screw 24 when the tip 20 of the driving portion 16 (which remains uncovered by the force applying member) is fully inserted into the tip receiving portion 26 provided to the head 22 of the screw 24. More particularly, it is desired that the force applying member be arranged on the tool to provide an even force upon the head 22 of the screw 24 when the tool is operably positioned upon the screw for the purpose of providing an anti-slip feature to the tool.

FIGS. 2A and 2B illustrate a first example of a force applying member 28. In this illustrated example, the force applying member 28, formed from a resilient material such as rubber or the like, is compression fit within the slot 18 formed in the driving portion 16 of the screwdriver 10. In the axial direction relative to the shaft 14, the force applying member 28 is sized larger than the slot 18 such that one or more sides of the force applying member 28 will extend outwardly from the slot 18 and, accordingly, extend outwardly from the driving portion 16. In this manner, when the exposed tip 20 of the driving portion 16 is inserted into the tip receiving portion 26 provided to the head 22 of the screw 24, a surface 28*a* of the portion(s) of the force applying member 28 that extend from the driving portion 16 and which face towards the head 22 of the screw 24 (when the screwdriver 10 is employed to drive a screw) will be frictionally engaged with a surface of the head 22 of the screw 24 that faces towards the force applying member 28 to thereby inhibit the driving portion 16 of the screwdriver 10 from slipping off of the head 22 of the screw 24. In a preferred embodiment, the exposed tip 20 of the driving portion 16 is dimensioned with a length, in the longitudinal direction relative to the shaft 14, that is intended to be slightly smaller than the depth that is provided to a conventional tip receiving portion 26 of the screw 24 such that the resilient force applying member 28 will be compressed and/or bent, and thereby caused to apply a downward force upon the surface of the head 22 of the screw 24, when the tip 20 is fully inserted into the tip receiving portion 26 to further enhance the engagement that is created between the screw 24 and the force applying member 28. It will also be appreciated that the force applying member 28 can be secured within the slot 18 using other methods, such as by being glued therein or the like. Additionally, it will be appreciated that one or more channels can be formed in the driving portion 16 and that the force applying member 28 (which, in this case, may be comprised of one or more discrete members) can be secured within such channels, though gluing or the like, as opposed to using a single element that is passed through the slot 18 as illustrated and described.

Figure 3A:
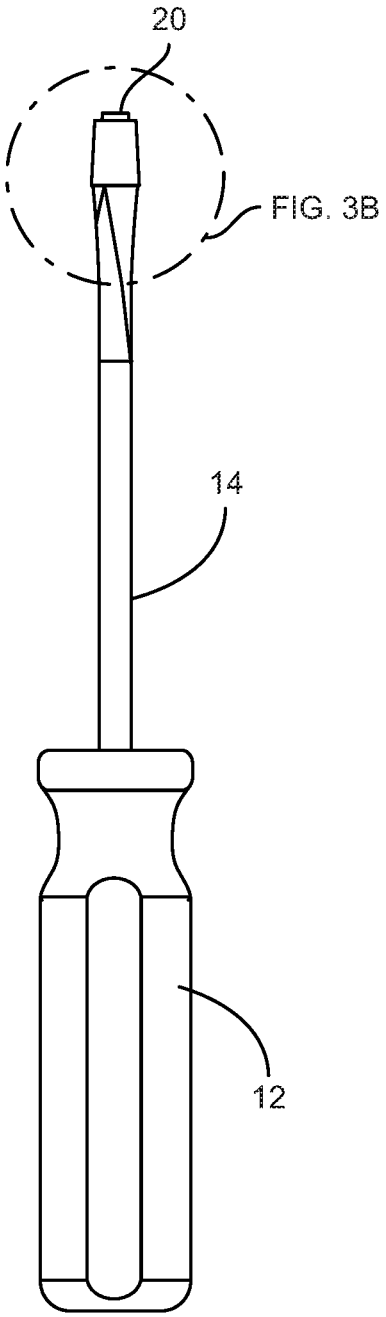
FIG. 3A illustrates a second example force applying member for use with the screwdriver illustrated in FIG. 1A.
Figure 3B:
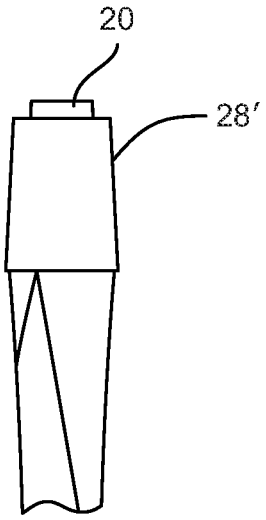
FIG. 3B illustrates a close up view of the second example force applying member of FIG. 3A.
Figure 3C:
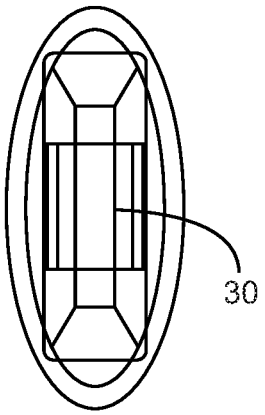
FIG. 3C illustrates a top view of the second example force applying member of FIG. 3A.
Figure 4A:
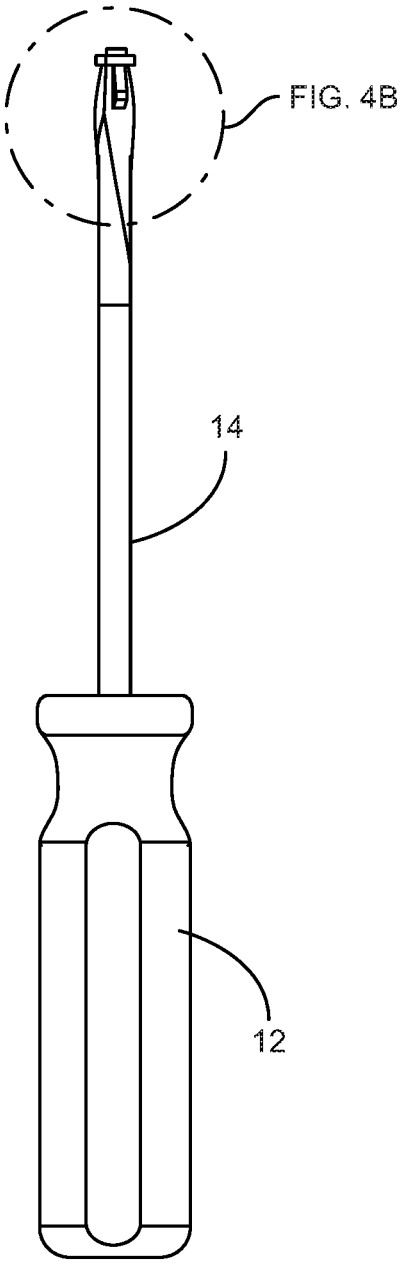
FIG. 4A illustrates a third example force applying member for use with the screwdriver illustrated in FIG. 1A.
Figure 4B:
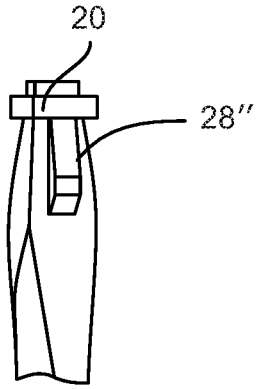
FIG. 4B illustrates a close up view of the third example force applying member of FIG. 4A.
Figure 4C:
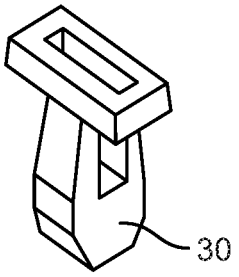
FIG. 4C illustrates an orthogonal view of the third example force applying member of FIG. 4A.
Figure 5A:
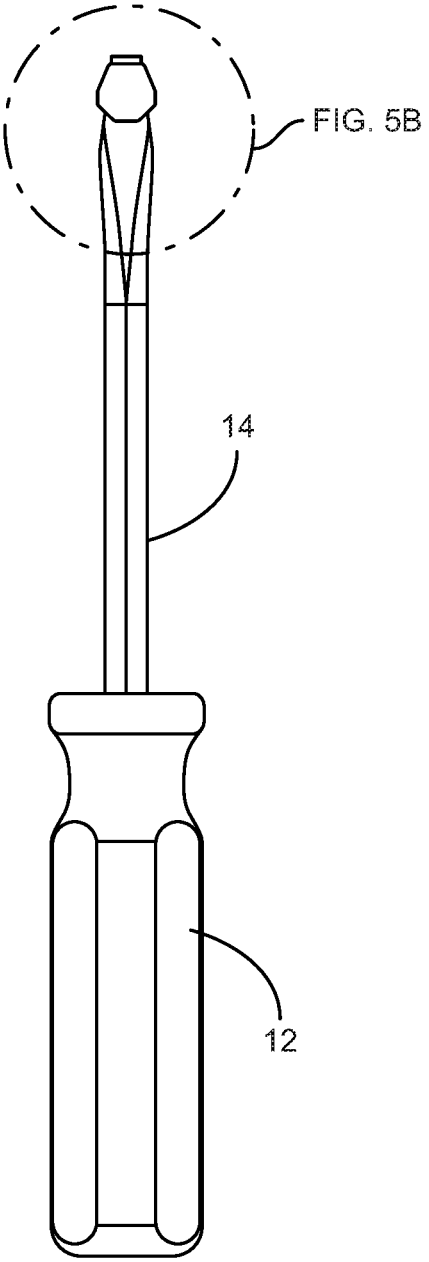
FIG. 5A illustrates a fourth example force applying member for use with the screwdriver illustrated in FIG. 1A.
Figure 5B:
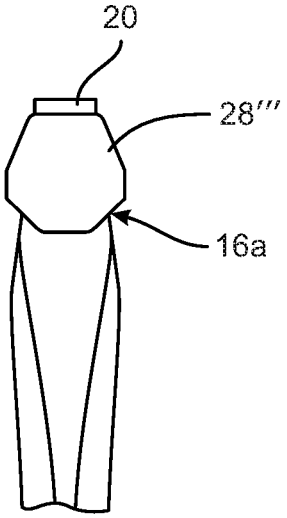
FIG. 5B illustrates a close up view of the fourth example force applying member of FIG. 5A.
Figure 5C:
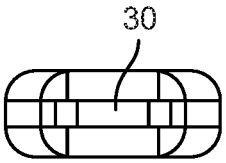
FIG. 5C illustrates a top view of the fourth example force applying member of FIG. 5A.

Turning to FIGS. 3-5 further, resilient force applying members 28', 28", and 28'" are illustrated. As described above, the force applying members 28', 28", and 28" are each intended to be secured to the driving portion 16 of the screwdriver 10. To this end, the force applying members 28', 28", and 28'" each include a portion 30 that is to be positioned within the slot 18 that is formed in the driving portion 16. The force applying members 28', 28", and 28'" are each arranged to surround at least a portion of the driving portion 16 while leaving the tip portion 20 of the driving portion 16 exposed to allow the tip portion 20 to be freely inserted into the tip receiving portion 26 of the screw 24 as described above. In this manner, when the tip portion 20 of the driving portion 16 is inserted into the tip receiving portion 26 of the screw 24, the force applying members 28', 28", and 28'" will again function to frictionally engage the screw 24. Preferably, the resilient, force applying members 28', 28", and 28'" are sized and arranged to provide a downward force upon the head of the screw when engaged with the screw as described above. The force applying member 28', 28", and 28'", because they are intended to surround at least a portion of the driving portion 16, may be molded directly onto (and into) the slot 18 of the driving portion 16. The portions 30 of the force applying members 28', 28", and 28'" that are intended to be positioned within the slot 18 may also be formed so as to be separable, e.g., at one side thereof, from the respective force applying member so that the force applying member may be deformed and slid upward over the driving portion 16 until the portion 30 aligns with and inserts itself into the slot 18 to thereby allow the force applying member to be quickly and easily removed as desired. Yet further, it is again contemplated that the portion 30 of force applying members 28', 28", and 28'" may be formed of two components that will be positioned within opposed sides of the slot 18 or formed of one or more components that will be positioned within one or more channels formed in the driving portion 16 as likewise described previously.

In instances where the tip portion 20 of the driving portion 16 of the tool is smaller relative to the shaft 14 or portions **16*a* of the driving portion 16 that extend away from the tip portion 20, e.g., in instances where the driving portion 16 has a trapezoidal like profile as shown in FIGS. 1A and 1B, it is contemplated that the force applying member can be fit over the driving portion 16 without the need to capture the force applying member in any slot feature provided to the driving portion 16. In this regard, by sizing the interior portion of the force applying member that is opposite to the tip portion 20 smaller than the size of the portion 16*a* of the driving portion 16 (or the shaft 14 if applicable), the tool can be provided with a feature that will inhibit a force-lessening, axial displacement of the force applying to member in a direction that is away from the tip portion 20 when the force applying member is engaged with the fastener 24 in the same manner that the engagement with the slot 28 also performs this function, i.e., to perform the function of maintaining the force applying member in axial compression when the tip portion 20 is fully inserted into the fastener. While not required, the portion of the force applying member that is intended to engage with the portion 16*a* of the driving portion (or other portion of the working element of the tool) can be formed from a relatively more rigid material (which may be separate from or integral with the resilient portion of the force applying member) to provide a collar that will engage the driving portion 16*a* to, as noted above, inhibit axial displacement of the force applying member when the force applying member is being used to provide an engagement force upon the fastener 24**.

Figure 6:
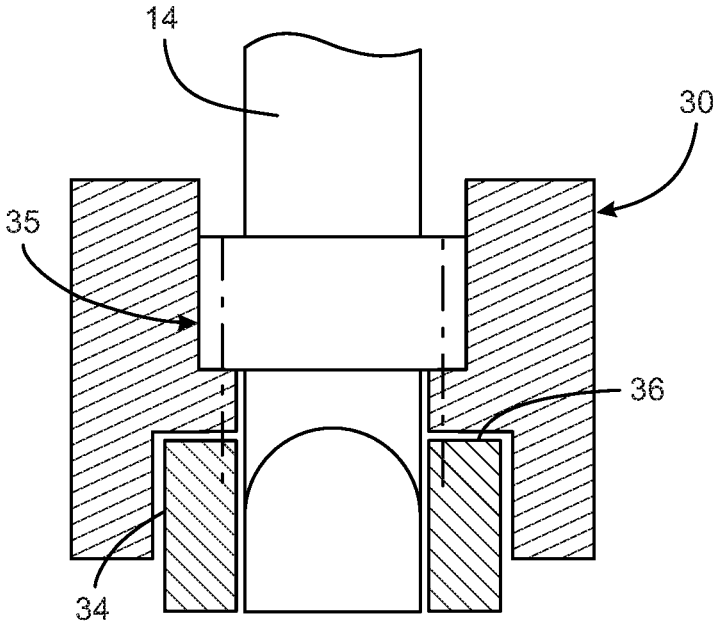
FIG. 6 illustrates a fifth example force applying member for use with a screwdriver.

Turning to FIG. 6, it is also contemplated that the tool can be provided with a force-lessening, axial displacement inhibiting feature by providing a threaded collar 30 that is intended to be engaged with corresponding threads 35 provided to a portion of the shaft 14 and/or driving portion 16. In the illustrated example of FIG. 6, the collar 30 is in the form of a separate element, formed from a metal or plastic material, that functions to form a slot 34 around the driving portion 16 in which is accommodated the resilient portion of the force applying member. In this manner, the end surfaces 36 of the formed slot 34 will function to inhibit the force applying member from being axially displaced when the force applying member is used to engage with the fastener 24 as described above. The resilient portion of the force applying member may be glued to or otherwise attached to the collar 30 or can be separable from the collar 30 as desired. It will also be appreciated that this embodiment, as well as others described above, has the advantage of allowing the force applying member (in whole or in part depending upon its construction) to be quickly and easily removed from a tool when the use of this feature is not wanted.

While various concepts have been described in detail, it will be appreciated by those skilled in the art that various modifications and alternatives to those concepts could be developed in light of the overall teachings of the disclosure. Accordingly, it will be appreciated that the particular concepts disclosed are meant to be illustrative only and not limiting as to the scope of the invention which is to be given the full breadth of the appended claims and any equivalents thereof.

What is claimed is:

1. A device for driving a fastener, comprising:

a handle;

a shaft extending from the handle;

a driving portion formed on an end of the shaft opposite the handle, the driving portion having a tip portion adapted to engage with a tip receiving portion of a head of the fastener and wherein the driving portion has a slot formed therein; and a force applying member formed from a resilient material securely engaged within the slot formed in the driving portion wherein the force applying member is arranged to leave a portion of the tip portion of the driving portion uncovered and wherein a surface of the force applying member which faces towards the tip portion of the driving portion is sized and arranged to form an interface for frictionally engaging with a surface of the head of the fastener that is located adjacent to the tip receiving portion of the head of the fastener when the tip portion of the driving portion is fully inserted into the tip receiving portion of the head of the fastener.

2. The device as recited in claim 1, wherein the force applying member is arranged such that the force applying member will be axially compressed when the tip portion of the driving portion is fully inserted into the tip receiving portion of the head of the fastener.

3. The device as recited in claim 2, wherein at least a portion of the force applying member surrounds the driving portion while leaving the portion of the tip portion of the driving portion uncovered.

4. The device as recited in claim 1, wherein the driving portion comprises a screwdriver tip.

5. The device as recited in claim 4, wherein the screwdriver tip comprises a flathead screwdriver tip.

6. A tool for driving a fastener, comprising:

a shaft;

a driving portion formed on an end of the shaft, the driving portion having a tip portion adapted to engage with a tip receiving portion of a head of the fastener; and a force applying member comprising a first portion formed from a resilient material wherein the force applying member is arranged relative to the driving portion to leave a portion of the tip portion of the driving portion uncovered wherein a surface of the first portion of the force applying member which faces towards the tip portion of the driving portion is sized and arranged to form an interface for frictionally engaging with a surface of the head of the fastener that is located adjacent to the tip receiving portion of the head of the fastener when the tip portion of the driving portion is fully inserted into the tip receiving portion of the head of the fastener, and wherein the force applying member is provided with a feature that is cooperable with a corresponding feature provided to the driving portion or the shaft to inhibit axial displacement of the force applying member when the tip portion of the driving portion is fully inserted into the tip receiving portion of the head of the fastener.

7. The tool as recited in claim 6, wherein the driving portion has a slot formed therein and wherein the force applying member comprises a second portion disposed within the slot and wherein the second portion disposed within the slot cooperates with the slot to inhibit axial displacement of the force applying member when the tip portion of the driving portion is fully inserted into the tip receiving portion of the head of the fastener.

8. The tool as recited in claim 7, wherein the first portion of the force applying member includes the second portion of the force applying member.

9. The tool as recited in claim 8, wherein opposed surfaces of the second portion of the force applying member are each integrally connected to the first portion of the force applying member.

10. The tool as recited in claim 8, wherein only one of opposed surfaces of the second portion of the force applying member is integrally connected to the first portion of the force applying member.

11. The tool as recited in claim 6, wherein the force applying member comprises a threaded collar cooperable with a threaded portion of the driving portion or the shaft and wherein the threaded collar cooperates with the threaded portion of the driving portion or the shaft to inhibit axial displacement of the force applying member when the tip portion of the driving portion is fully inserted into the tip receiving portion of the head of the fastener.

12. The tool as recited in claim 6, wherein the force applying member comprises a second portion that is provided with an opening that is sized smaller than a portion of the driving portion or the shaft and wherein the second portion cooperates with the portion of the driving portion of the shaft to inhibit axial displacement of the force applying member when the tip portion of the driving portion is fully inserted into the tip receiving portion of the head of the fastener.

13. The tool as recited in claim 12, wherein the second portion is integrally formed with the first portion of the force applying member.

14. The tool as recited in claim 12, wherein the second portion is separable from the first portion of the force applying member.

15. The tool as recited in claim 6, wherein the first portion of the force applying member surrounds the driving portion while leaving the portion of the tip portion of the driving portion uncovered.

16. The tool as recited in claim 6, wherein the driving portion comprises a screwdriver tip.

17. The tool as recited in claim 16, wherein the screwdriver tip comprises a flathead screwdriver tip.

* * * * *